US005702743A

United States Patent [19]

Wells

[11] Patent Number: 5,702,743

[45] Date of Patent: *Dec. 30, 1997

[54] RIGID RECLOSABLE BACON PACKAGE

[75] Inventor: Cindie M. Wells, Cambridge, Wis.

[73] Assignee: Kraft Foods, Inc., Northfield, Ill.

[ * ] Notice: The term of this patent shall not extend beyond the expiration date of Pat. No. 5,520,939.

[21] Appl. No.: 653,187

[22] Filed: May 24, 1996

Related U.S. Application Data

[63] Continuation of Ser. No. 220,849, Mar. 31, 1994, Pat. No. 5,520,939.

[51] Int. Cl.[6] ..... B65D 85/62

[52] U.S. Cl. ..... 426/129; 426/106; 426/112; 206/518; 206/471; 206/815; 220/307; 220/516

[58] Field of Search ..... 426/106, 112, 426/119, 124, 129, 121, 396; 229/2.5 R; 220/307, 516; 206/518, 561, 564, 471, 815; 53/86

[56] References Cited

U.S. PATENT DOCUMENTS

| | | | |
|---|---|---|---|
| 2,995,269 | 8/1961 | Pease | 220/60 |
| 3,051,584 | 8/1962 | Tindall | 426/129 X |
| 3,101,864 | 8/1963 | Glickman | 270/60 |
| 3,145,112 | 8/1964 | Boegershausen | 426/121 |
| 3,326,408 | 6/1967 | Ringlen | 426/106 X |
| 3,338,723 | 8/1967 | Lundquist | 426/121 |
| 3,351,265 | 11/1967 | Miller | 229/43 |
| 3,360,119 | 12/1967 | Mullinix | 426/121 X |
| 3,454,158 | 7/1969 | Tigner | 426/129 X |
| 3,490,576 | 1/1970 | Alessi et al. | 426/121 X |
| 3,537,497 | 11/1970 | Dickow et al. | 146/222 |
| 3,552,634 | 1/1971 | Ollier et al. | 229/43 |
| 3,625,713 | 12/1971 | Mixon | 426/129 X |
| 3,650,386 | 3/1972 | Tigner | 426/129 X |
| 3,676,159 | 7/1972 | Fallowfield | 426/129 X |
| 3,792,181 | 2/1974 | Mahaffy et al. | 426/129 X |
| 3,803,332 | 4/1974 | Seiferth et al. | 426/121 |
| 3,972,155 | 8/1976 | Mahaffy et al. | 53/30 R |
| 3,999,661 | 12/1976 | Jones | 206/591 |
| 4,058,953 | 11/1977 | Sanborn, Jr. et al. | 426/396 X |
| 4,091,930 | 5/1978 | Buchner et al. | 206/605 |
| 4,124,141 | 11/1978 | Armentrout et al. | 426/396 X |
| 4,277,931 | 7/1981 | Mahaffy et al. | 53/412 |
| 4,427,129 | 1/1984 | Wyslotsky et al. | 220/306 |
| 4,427,705 | 1/1984 | Wyslotsky et al. | 426/106 |
| 4,664,922 | 5/1987 | Leon et al. | 426/124 |
| 4,819,412 | 4/1989 | Sengewald | 53/471 |
| 4,840,271 | 6/1989 | Garwood | 426/129 X |
| 4,886,690 | 12/1989 | Davis et al. | 428/36.6 |
| 4,892,220 | 1/1990 | Foos | 220/339 |
| 4,910,033 | 3/1990 | Bekele et al. | 426/129 |
| 4,954,356 | 9/1990 | Kappes | 426/107 |
| 4,986,438 | 1/1991 | Borst | 220/315 |
| 5,007,231 | 4/1991 | Ingemann | 53/412 |
| 5,034,074 | 7/1991 | Thomas, Jr. | 156/69 |
| 5,044,495 | 9/1991 | Wyslotsky | 206/315.9 |
| 5,058,761 | 10/1991 | Williams | 220/306 |
| 5,079,059 | 1/1992 | Wyslotsky | 428/43 |
| 5,092,479 | 3/1992 | Wells | 220/4.23 |
| 5,096,084 | 3/1992 | Wells | 220/337 |
| 5,131,551 | 7/1992 | Wells | 220/4.23 |
| 5,163,269 | 11/1992 | Williams | 53/412 |
| 5,204,130 | 4/1993 | McDevitt et al. | 426/115 |
| 5,240,133 | 8/1993 | Thomas, Jr. | 220/359 |
| 5,242,696 | 9/1993 | McDevitt | 426/129 X |
| 5,246,720 | 9/1993 | Buchko | 426/106 |
| 5,520,939 | 5/1996 | Wells | 426/129 |

*Primary Examiner*—Milton Cano

*Attorney, Agent, or Firm*—Lockwood, Alex, Fitzgibbon & Cummings

[57] ABSTRACT

A shaped generally rigid, synthetic plastic sealed package having multiple stacks of sliced bacon is provided. A generally rigid cover is releasably hermetically secured to a rigid tray. Package walls are substantially transparent so that the consumer can readily inspect, prior to purchase, multiple entire lengths of bacon slice surfaces. At least two stacks of vertically aligned bacon slices are arranged longitudinally in side-by-side relationship to each other.

27 Claims, 2 Drawing Sheets

RIGID RECLOSABLE BACON PACKAGE

This application is a continuation, of application Ser. No. 08/220,849, filed Mar. 31, 1994, now U.S. Pat. No. 5,520,939.

BACKGROUND AND DESCRIPTION OF THE INVENTION

The present invention generally relates to packages for stacks of bacon slices, more particularly to hermetically sealed merchandizing containers for multiple vertical stacks of bacon slices which are containerized and displayed in side-by-side fashion such that more than one face of the bacon is visible to the consumer prior to purchase. The invention makes it possible for the consumer to view multiple-entire lengths of bacon slice edges without shingling the bacon slices. The package includes a tray and a cover, both of which are shaped, generally rigid and substantially transparent. The tray and cover are hermetically sealed together in a releasable fashion, and the cover is reclosable onto the tray so as to provide relatively easy access to the bacon and easy reclosure after less than all of the bacon has been removed from the package.

Bacon has long been available to retail consumers in sliced form, often within hermetically sealed packages. A typical package in this regard is a package containing approximately one pound of sliced bacon in a single shingled array which is hermetically sealed. Often, these packages are vacuum sealed. Typically, provision is made for viewing a portion of some of the shingled bacon slices. An example of such a bacon package is shown in Seiferth et al U.S. Pat. No. 3,803,332, incorporated by reference hereinto. Often, substantial portions of the bacon slices are obscured by a package of this type because it includes a so-called bacon board which is not transparent and which supports the shingled bacon during shipping, handling and in-home usage. Concerns are at times expressed by consumers that not enough surface area of the bacon slices is visible prior to purchase by the consumer. Consumers have expressed a concern that the "fatty" slices are intentionally hidden within the package, even though this is not a practical possibility in modern commercial-scale bacon processing operations.

Another concern which has at times been expressed by consumers is that bacon packages require the consumer's fingers to contact the packaging that has been exposed to the fat of the bacon in order to remove a bacon slice from the package. Usually, in order to gain access to a slice, the consumer must open and hold open a package panel or otherwise touch a part of the package which has a coating of fat on it. This fat contact can occur when opening the package, when accessing a previously opened package and/or when holding an open package during the course of removing a slice or slices therefrom.

Most current bacon packages hermetically seal the bacon slices within flexible films. This type of packaging can give an appearance which falls far short of that of a premium package. For example, the flexible film can loosely surround the bacon slices (especially in the case of a gas flushed package) or take on a loose or unstructured appearance once opened (in the case of flexible packages, including those which had been vacuum packaged). Also, many bacon packages are not truly reclosable in that they do not have positive means by which the package can be reclosed in order to securely contain the remaining bacon strips within the package once it has been opened and the bacon has been partially consumed.

In summary, the present invention provides reclosable bacon packaging that has a rigid tray for receiving the bacon and a rigid cover or lid that is hermetically sealed and, once the hermetic seal is broken, the package is easily reclosed. The package offers a unique presentation of bacon strips. The bacon strips are presented in two or more vertically aligned or non-shingled stacks which are side-by-side of each other along adjacent longitudinal edges of the opposing respective stacks. Prior to opening, the rigid tray and rigid cover are hermetically sealed to each other in an easy release fashion. The rigid cover is readily reclosed onto the rigid tray by a structure which preferably includes mating engagement between a peripheral inset surface and a peripheral surface that projects into and engages the peripheral inset surface.

It is accordingly a general object of the present invention to provide an improved shaped, generally rigid synthetic plastic bacon package.

Another object of the present invention is to provide an improved bacon package that is substantially entirely rigid or semi-rigid to the extent that the polymeric material of the package is formed and reclosable.

Another object of this invention is to provide an improved bacon package that offers a unique presentation of bacon strips within rigid packaging in which every panel is transparent.

Another object of the present invention is to provide a rigid bacon package that is reclosable with a snap fit while affording easy product accessibility.

Another object of this invention is to provide a bacon package having both a rigid tray and a rigid cover, which package is reclosable and offers good product visibility, improved slice separation and premium package appearance.

Another object of the present invention is to provide an improved bacon package wherein the lean edges of the slices are exposed on at least two sides or ends of the package and full slices or substantially full slices may be viewed from the top and the bottom, depending upon labeling requirements and label attributes.

Another object of the invention is to provide an improved sliced bacon package wherein the leaner edges of each slice are positioned toward the outside of the package while the less lean edge of each slice is positioned toward the inside of the package.

Another object of this invention is to provide an improved package for sliced bacon which minimizes contact between fatty coated package panels and the consumer's fingers when removing slices from the package.

Another object of this invention is to provide bacon packaging that is suitable for gas flushing to offer improved slice separation and to account for slice size variation.

Another object of this invention is to provide improved bacon packages that are stackable or nestable one on top of the other so as to provide compact and secure stacking.

These and other objects, features and advantages of the present invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
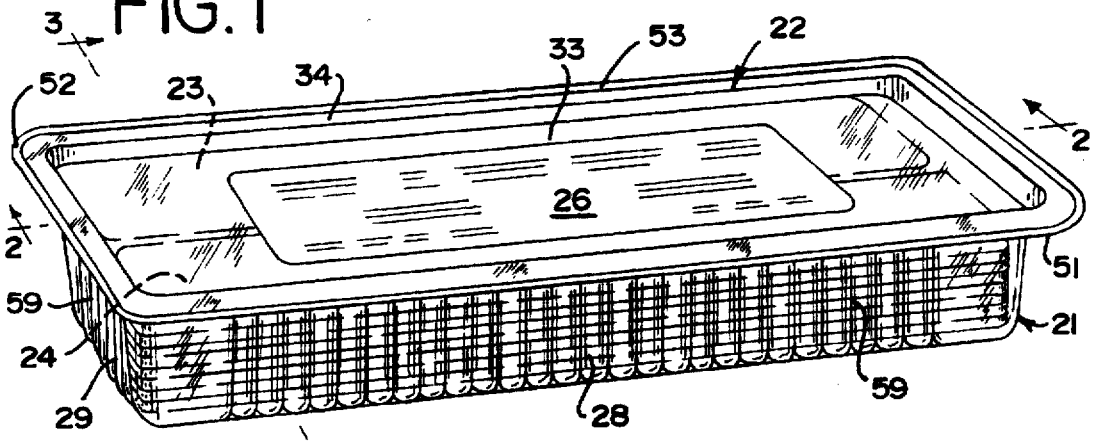
FIG. 1 is a perspective view of a preferred sealed package in accordance with the present invention, showing two stacks of bacon sealed therewithin.
Figure 2:
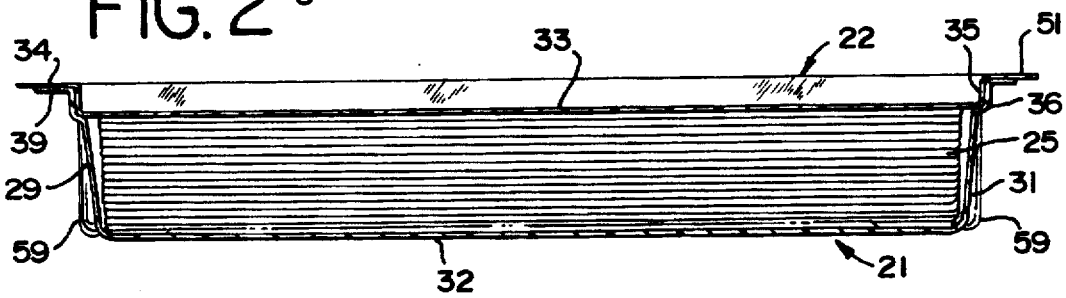
FIG. 2 is cross-sectional view along the line 2—2 of FIG. 1.
Figure 3:
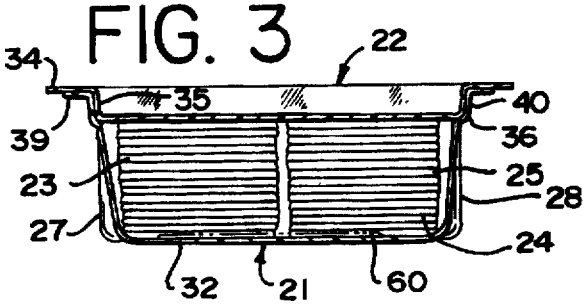
FIG. 3 is a cross-sectional view along the line 3—3 of FIG. 1.

A shaped, generally rigid synthetic plastic package for storing stacks of sliced bacon in accordance with the present invention which is illustrated in FIG. 1 includes a tray member, generally designated as 21, and a cover or lid member, generally designated as 22. Both tray member 21 and cover member 22 are non-flexible film in that the film is semi-rigid or rigid and had been shaped or is shaped on-line, such as by suitable forming or heat molding techniques, into the shapes illustrated in the drawings which retain their respective shapes during normal handling. As thus shaped, they provide a somewhat protective and premium-appearing package for the bacon stacks. In the illustrated packages, two or more stacks 23, 24 of bacon slices 25 are sealed therewithin. The tray member 21 and the cover member 22 are transparent to the extent that the bacon slices therewithin can be readily viewed and inspected by a consumer prior to purchase. One or more labels 26 may be included in order to satisfy marketing and labeling needs and requirements. When desired one or more any such label can be itself transparent except, of course, for the message indicia that need to be opaque or translucent or contrasting in order to be visible to the consumer.

It will be appreciated that the bacon slices or strips 25 are in substantial vertical alignment with each other in each of the stacks 23, 24. With this arrangement, the entirety of the outwardly facing edges of each slice 25 and both end edges of the stacks 23 and 24 are visible to the consumer prior to purchase by inspection through both longitudinal side panels 27, 28 and both tray end panels 29, 31 of the package. Furthermore, the entirety of the outwardly disposed or bottom surfaces of the bottom slice of both stacks are visible through the tray bottom panel 32. All or substantially all of the uppermost outwardly facing or top surfaces of both stacks are visible through cover panel 33 of the cover portion 22. With this arrangement, the entirety or virtually the entirety of all of three of the four edges of each bacon slice and the top and bottom surface of each bacon stack are visible to the consumer prior to purchasing and opening the package of bacon in accordance with the present invention.

As illustrated, a cover panel 33 of the cover member 22 is inset or pedestal-like. More particularly, a peripheral flange 34 of the cover member is spaced away from the cover panel 33 by a peripheral inset portion 35. In this manner, the cover panel 33 projects into the tray member 21 when the package is in its closed condition. Peripheral inset portion 35 engages each of the longitudinal side panels 27, 28 and tray end panels 29, 31 of the tray member. Preferably this engagement is along a receptor portion of these tray panels. Illustrated in this regard is a peripheral ledge portion 36 positioned along the upper periphery of the sidewall of the tray member which is defined by side panels 27, 28 and end panels 29, 31. The peripheral end portion 40 of these side panels and end panels which is above or outside of the peripheral ledge portion 36 matingly receives peripheral inset portion 35 of the cover member in order to provide a reclosure feature.

Often, a tight fit or friction fit between the peripheral inset portion 35 of the cover member and the peripheral end portion 40 of the tray member will provide an adequate, positively acting reclosure feature by which the consumer has an audible acknowledgement and/or a tactile experience of closure completion by having a tight fitting arrangement wherein the location along the peripheral inset portion of the cover member is peripherally larger than the peripheral size of a location along the height of the peripheral end portion of the tray member. This aspect of the invention can be accentuated by proceeding with embodiments such as shown in FIG. 5 and/or in FIG. 6.

Figure 5:
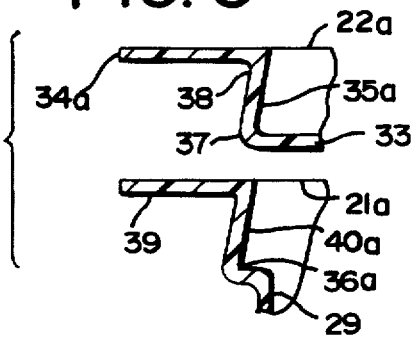
FIG. 5 is a partial sectional, exploded view showing an alternate snap-closure feature.
Figure 6:
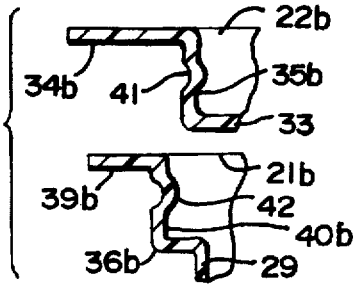
FIG. 6 is a partial sectional, exploded view showing an another snap-closure feature.

FIG. 5 illustrates a cover member 22*a* having a peripheral inset portion 35*a* which is tapered to the extent that the periphery of its lower portion 37 is greater than the periphery of its upper portion 38. Corresponding tray member 21*a* has a peripheral ledge portion 36*a* and a peripheral end portion 40*a* which generally corresponds in shape and angular offset to those of the peripheral inset portion 35*a*. When closed, flange 34*a* of the cover member 22*a* closely overlies and preferably engages flange 39 of the tray member 21*a* when the reclosure operation has been completed. FIG. 6 shows a cover member 22*b* having a peripheral inset portion 35*b* which includes an indent 41. A corresponding detent 42 is provided in the peripheral end portion 40*b* above the peripheral ledge portion 36*b*. A plurality of such indent and detent pairs can be provided along the periphery of the tray member and of the cover member, or the indents and detents can be continuous along the respective peripheries of the tray member and cover member. Any combination of these reclosure enhancing features can be included as desired, depending upon the extent of positive reclosability that is needed.

Figure 4:
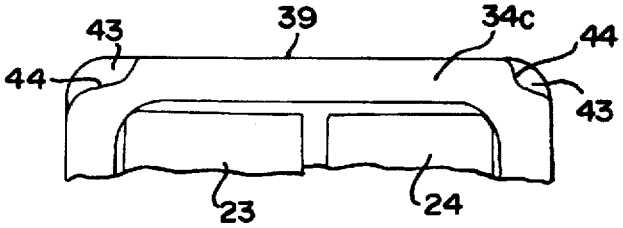
FIG. 4 is a detailed view of a portion of the package flange area showing an easy-access opening feature.

In the FIG. 6 illustrated embodiment, at least a portion of the flange 39*b* of the tray member 21*b* is shorter than a corresponding portion of the peripheral flange 34*b* of the cover member 22*b*. This is provided in order to facilitate separation of the cover member and the tray member. A reverse arrangement is also contemplated in which a portion of the tray member flange 39*b* is larger than and extends beyond a corresponding portion of the cover member flange 34*b*. As an example, the entirety of an end flange of the tray member can be shorter than the entirety of the end flange of the cover member, or vice versa. In another arrangement, this difference in the extent of the tray member flange and of the cover member flange can take the form of a digit grasping section 43 as generally illustrated in FIG. 4. As illustrated, the digit grasping section 43 is in the peripheral flange 39 of the tray member 39, while a cut-out 44 is provided in the peripheral flange 34*c* of the cover member. Any combination of these various features for facilitating grasping by digital manipulation can be provided as desired.

An important aspect of packages in accordance with this invention is the inclusion of a hermetic sealing feature. This hermetic sealing feature has a peelability aspect such that the package can be opened by the use of digital forces and without substantially distorting the cover member or lid member and/or its peripheral flange and/or the peripheral flange of the tray member. Depending upon the particular materials out of which the shaped tray member and lid or cover member are made, suitable sealants or adhesives can provide a suitable easily peeling or releasing hermetic seal. When the desired peelability and hermetic sealing attributes can be attained without distortion of the packaging components during initial opening, no further sealing and opening means need be provided.

In other instances, the packaging materials and/or sealant or adhesive component make it difficult to formulate a combination of polymer and peelable sealant that will successfully withstand shipping and storage conditions and still open without unacceptably distorting or damaging the package, especially the lid member or the substantially mating respective peripheral flanges of the tray member and lid member. In those instances, the peelable sealing films or sealants are supplemented by a tear strip arrangement whereby the tear strip is pulled away in a peelable fashion and discarded, leaving an adequate peripheral flange on both the lid and the tray in order to achieve the reclosability features discussed herein.

Figure 7:
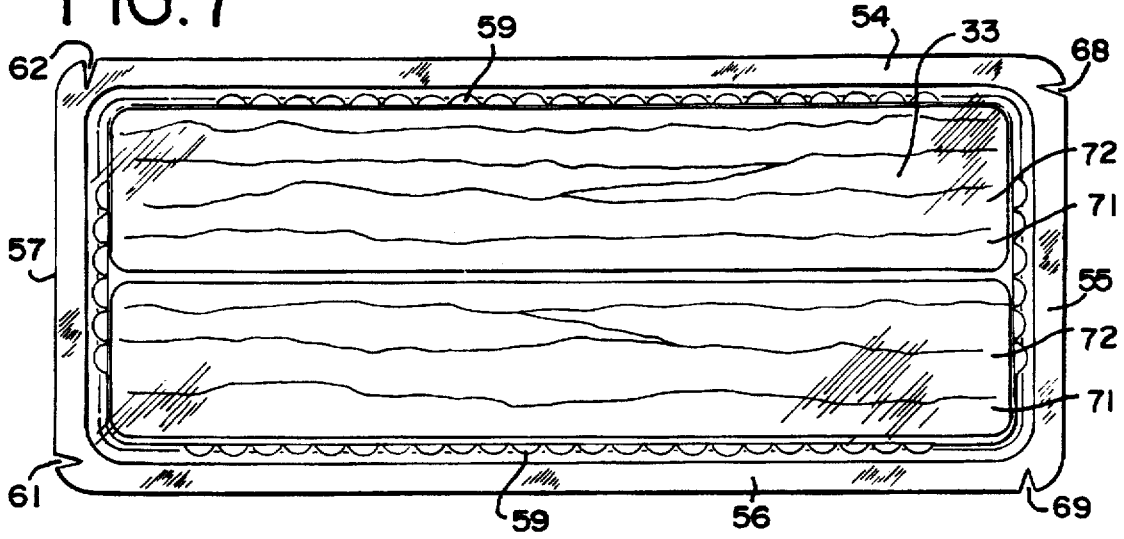
FIG. 7 is a top plan view of an embodiment in accordance with the present invention showing an easy-open feature.

FIG. 1 illustrates an embodiment wherein a peelable seal is assisted by a pull strip. In this instance, pull strip 51 peripherally surrounds the rest of the flange 34. In this illustrated embodiment, the pull strip runs for the entire periphery of the flange beginning at an initiation location 52. The illustrated pull strip includes a score line 53 to facilitate separation of the pull strip 51 from the rest of the flange. An illustrative pull strip including these general characteristics is described in U.S. Pat. No. 5,079,059, incorporated by reference hereinto. A similar arrangement is illustrated in FIG. 7 wherein a plurality of edge strips 54, 55, 56, 57 are removed by grasping at respective incisions 58, 59, 61, 62. General features of this type of tear strip arrangement are found in U.S. Pat. No. 4,091,930, incorporated by reference hereinto.

Figure 11:
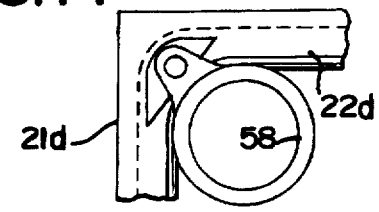
FIG. 11 is a detailed plan view illustrating another embodiment of an easy-open feature.

FIG. 11 illustrates an embodiment which incorporates a permanent seal that has an easy open feature by which cover member **22*d* is removed from tray member 21*d* by operation of a frangible component. The illustrated embodiment includes a pull ring 58 which, once lifted, breaks a permanent seal, such as under the pull ring 58. Thus opened, the pull ring 58 is used to easily peel the remainder of the cover member or lid member 22*d*** away from and off of the tray. Features along these lines are illustrated in U.S. Pat. No. 5,007,231, incorporated by reference hereinto.

Other peelable lid devices include those shown in U.S. Pat. No. 3,552,634, incorporated by reference hereinto, which shows a reusable lid which can require the use of a tool to open it. Another approach is found in U.S. Pat. Nos. 5,034,074, 5,160,391 and No. 5,240,133, also incorporated by reference hereinto.

Preferably, a plurality of wall ribs 59 are included in each longitudinal side panel 27, 28 and end panel 29, 31 of the tray member. This enhances the rigidity of the tray to prevent damage to the product during handling and to enhance the maintenance of the double stacks of bacon in their advantageously displayed orientation as shown in the drawings. Additionally, ribs 60 are preferably included within the bottom panel 32 of the tray. This assists in providing adequate support for the weight of bacon within the package to thereby enhance the overall rigidity and premium characteristics of the tray member. In addition to the weight of the bacon, these ribs 60 help to prevent buckling or sagging of the tray member due to pressure exerted on a bacon stack by the inside-surface of the cover member when the height of the stack is such that the stack engages both the bottom inside surface of the tray member and the top inside surface of the cover member, even to the extent that slice compression can occur depending upon the particular height of the stack. The ribs can also help to facilitate flow of inert gas atmosphere within the package when same is gas flushed with gases such as nitrogen, carbon dioxide and the like.

Preferably, the packages according to the invention are gas flushed, although they could be vacuum sealed if desired. The ribs also assist in preventing the bacon slices from adhering or sticking to the tray, especially the bottom of the tray. Gas flushed packaging improves slice separation and more easily accounts for slice size variations when compared with vacuum packaging which can experience package distortion, buckling and resultant leaking caused by slice size variations.

The combination including a gas flushed package, a wide-mouthed package with a peripheral flange, and a flanged lid that can be completely removed from the tray containing the stacked bacon slices allows the consumer to remove a slice or slices from the opened package without requiring the consumer's fingers to contact the inside surfaces of the tray, which can be laden with fat by virtue of extended contact with the bacon slices. A feature of the package is easy access to slices without having to contact surfaces of the packages that have fat residue thereon. It is even possible to thus easily and cleanly access a slice with a suitable tool such as a fork or a pair of tongs and remove the slice entirely from the package without any contact between the consumer's fingers and the bacon.

In addition, it will be noted that the peripheral flange 34, inset portion 35 and panel 33 of the cover member are preferably sized so as to accommodate reception of the bottom panel of the tray member of another package, including any ribs positioned thereon. With this feature, the packages are nestable or stackable one onto to another so that the packages can be placed on top of one another without the package on top sliding off of the package below.

Figure 8:
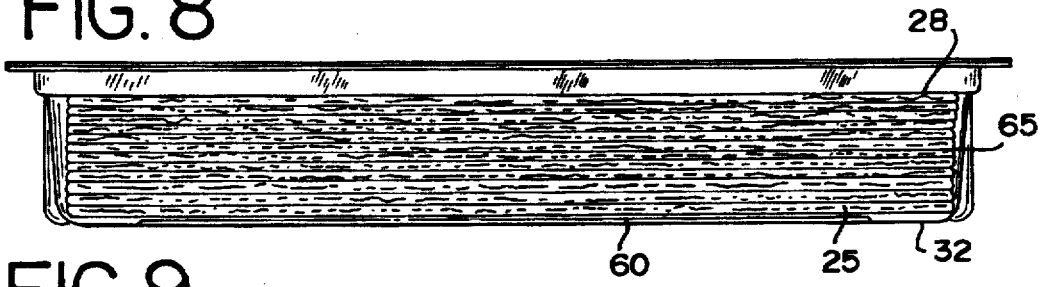
FIG. 8 is a side elevational view of the embodiment shown in FIG. 7.
Figure 9:
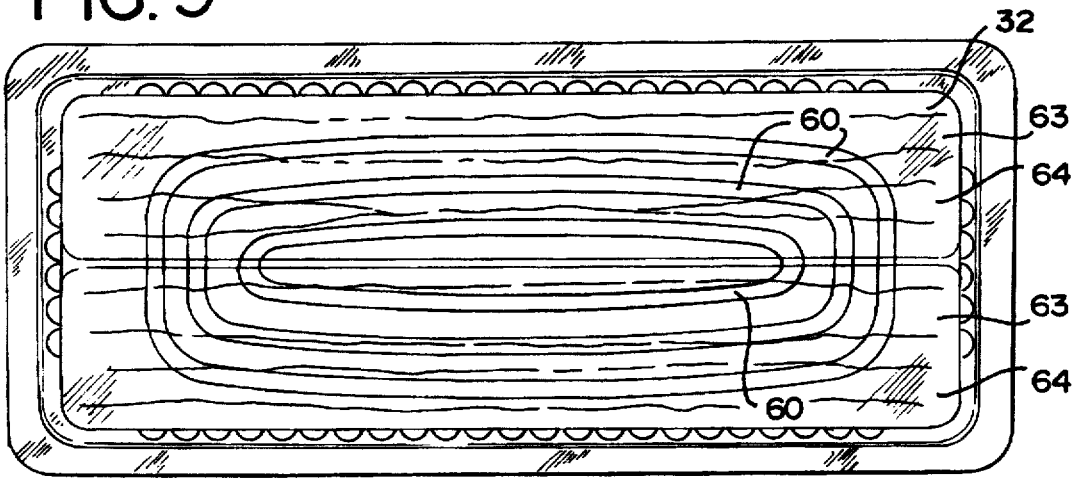
FIG. 9 is a bottom view of the package illustrated in FIG. 7.
Figure 10:
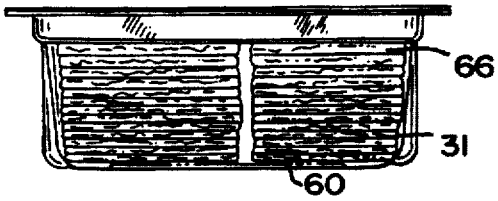
FIG. 10 is an end elevational view of a bacon-containing package in accordance with the present invention.

An important aspect of the invention wherein multiple facets of the bacon slices packaged in accordance with the present invention are visible through the packaging is further illustrated in FIGS. 7, 8, 9 and 10. Both lean areas 61 and fat areas 62 are clearly visible through the cover panel 33 even when the package is fully sealed as shown in these drawings. Only labeling (see, for example, FIG. 1) would prevent easy inspection of the top slices of both stacks as shown in FIG. 7. Similarly, lean areas 63 and fat areas 64 are visible through the tray bottom panel 32, as can be seen in FIG. 9. FIG. 8 illustrates that the entirety of the longitudinal edges 65 of bacon slices 25 are readily inspected through the transparent longitudinal side panel 28 of the tray. The same is the case for the longitudinal side panel 27 of the tray. In addition, FIG. 10 shows that each and every end edge 66 of all of the stacked bacon slices are visible through tray end panel 31. The same is true for tray end panel 29. Accordingly, it will be appreciated that one full surface area of each of four different bacon slices (obscured only by desired labeling), and both end edges and one longitudinal edge of each and every slice of bacon, are visible to the consumer before the package is opened.

It will thus be seen that the present invention provides a new, useful and unique merchandising package for sliced bacon, which package has a number of advantages and characteristics including those pointed out herein and others which are apparent. Preferred embodiments of the invention have been described by way of example, and it is anticipated that modifications may be made to the described form without departing from the spirit of the invention or the scope of the appended claims.

I claim:

1. A shaped, generally rigid synthetic plastic sealed package for packaging sliced bacon, the package being reclosable and comprising:

a shaped, generally rigid tray member having a bottom panel, side panels defining a generally upstanding sidewall and an open mouth generally opposite to said bottom panel, said open mouth being defined between said generally upstanding sidewall and a tray member peripheral flange;

a shaped, generally rigid cover member secured onto said tray member, said cover member having a cover panel, a cover member peripheral flange, and a peripheral inset portion joining said cover panel and said cover member peripheral flange, said peripheral inset portion being substantially parallel to the generally upstanding sidewall of the tray member, and said cover panel being spaced from said cover member peripheral flange;

said bottom panel of the tray member, said sidewall of the tray member, and said cover panel of said cover member are sized and shaped to enclose therewithin at least two separate stacks of bacon strips arranged in longitudinal side-by-side relationship with each other, said bottom panel having a length substantially the same as the length of a bacon strip to be packaged therewithin and having a width substantially the same as the width of such a bacon strip multiplied by an integer of at least two, said bottom panel and generally upstanding side wall having transparency properties to permit inspection therethrough of sliced bacon within the tray member; and means for releasably hermetically sealing together said tray member peripheral flange to said cover member peripheral flange.

2. The bacon package in accordance with claim 1, wherein each of said tray member bottom panel and upstanding sidewalls are substantially transparent.

3. The bacon package in accordance with claim 1, wherein said generally upstanding sidewall of the tray member includes a peripheral ledge portion and a peripheral end portion which further define said tray member mouth, said peripheral end portion being sized and shaped so as to matingly engage said peripheral inset portion of the cover member.

4. The bacon package in accordance with claim 3, wherein said peripheral inset portion of the cover member includes means for interfering with at least a portion of said generally upstanding sidewall of the tray member at a location generally along said peripheral end portion of the tray member.

5. The bacon package in accordance with claim 1, wherein said generally upstanding sidewall of the tray member includes a peripheral ledge portion and a peripheral end portion which further define said tray member mouth, said peripheral end portion being sized and shaped so as to receive therewithin said peripheral inset portion of the cover member.

6. The bacon package in accordance with claim 1, further including ribs within said generally upstanding sidewall of the tray member.

7. The bacon package in accordance with claim 6, further including at least one rib within said bottom panel of the tray member.

8. The bacon package in accordance with claim 1, further including at least one rib within said bottom panel of the tray member.

9. The bacon package in accordance with claim 1, wherein said sealed package is gas flushed.

10. The bacon package in accordance with claim 1, wherein at least a portion of said tray member peripheral flange extends beyond a corresponding portion of said peripheral flange.

11. The bacon package in accordance with claim 1, wherein said means for releasably hermetically sealing together said tray member peripheral flange to said cover member peripheral flange includes a pull strip by which a portion of one of said peripheral flanges is peeled from the other peripheral flange and removed for unsealing said package.

12. The bacon package in accordance with claim 1, wherein said means for releasably hermetically sealing together said tray member peripheral flange to said cover member peripheral flange includes releasable polymer at said flanges.

13. The bacon package in accordance with claim 1, wherein said means for releasably hermetically sealing together said tray member peripheral flange to said cover member peripheral flange includes a permanent hermetic seal and a grasping member for breaking said permanent hermetic seal in order to open said package.

14. The bacon package in accordance with claim 1, wherein at least a portion of said cover member peripheral flange extends beyond a corresponding portion of said tray member peripheral flange.

15. A sealed package containing stacks of bacon therewithin, the package being hermetically sealed and reclosable, the package comprising:

at least two stacks of bacon strips;

a shaped, generally rigid tray member having a bottom panel, side panels defining a generally upstanding sidewall and an open mouth generally opposite to said bottom panel, said open mouth being defined between said generally upstanding sidewall and a tray member peripheral flange, said bottom panel and generally upstanding sidewall having transparency attributes to permit inspection therethrough of said stacks within the tray member, said bottom panel having a length substantially the same as the length of said bacon strips and having a width substantially the same as the width of said bacon strips multiplied by an integer of at least two;

a shaped, generally rigid cover member secured onto said tray member, said cover member having a cover panel, a cover member peripheral flange, and a peripheral inset portion joining said cover panel and said cover member peripheral flange, said peripheral inset portion being substantially parallel to the generally upstanding sidewall of the tray member, and said cover panel being spaced from said cover member peripheral flange;

said at least two separate stacks being arranged in longitudinal side-by-side relationship with each other, each said stack having a bottom bacon strip, and said bottom bacon strip of each said stack substantially engaging each other along respective longitudinal edges thereof to define an area which substantially coincides with that of said bottom panel, said separate stacks being sealed within said package such that substantial portions of each of at least two edges of each strip of bacon within each stack and a bottom surface area of each strip at the bottom are visible through respective package panels; and means for releasably hermetically sealing together said tray member peripheral flange to said cover member peripheral flange.

16. The packaged bacon in accordance with claim 15, wherein each of said tray member bottom panel and upstanding sidewalls are substantially transparent.

17. The bacon packaged in accordance with claim 15, wherein said generally upstanding sidewall of the tray member includes a peripheral ledge portion and a peripheral end portion which further define said tray member mouth, said peripheral end portion being sized and shaped so as to matingly engage said peripheral inset portion of the cover member.

18. The packaged bacon in accordance with claim 17, wherein said peripheral inset portion of the cover member includes means for interfering with at least a portion of said generally upstanding sidewall of the tray member at a location generally on said peripheral end portion of the tray member.

19. The packaged bacon in accordance with claim 15, wherein said generally upstanding sidewall of the tray member includes a peripheral ledge portion and a peripheral end portion which further define said tray member mouth, said peripheral end portion being sized and shaped so as to receive therewithin said peripheral inset portion of the cover member.

20. The packaged bacon in accordance with claim 15, further including ribs within said generally upstanding sidewall of the tray member.

21. The packaged bacon in accordance with claim 20, further including at least one rib within said bottom panel of the tray member.

22. The packaged bacon in accordance with claim 15, wherein said sealed package is gas flushed.

23. The packaged bacon in accordance with claim 15, wherein at least a portion of said cover member peripheral flange extends beyond a corresponding portion of said tray member peripheral flange.

24. The packaged bacon in accordance with claim 15, wherein said means for releasably hermetically sealing together said tray member peripheral flange to said cover member peripheral flange includes a pull strip by which a portion of one of said peripheral flanges is peeled from the other peripheral flange and removed for unsealing said package.

25. The packaged bacon in accordance with claim 15, wherein said means for releasably hermetically sealing together said tray member peripheral flange to said cover member peripheral flange includes releasable polymer at said flanges.

26. The packaged bacon in accordance with claim 15, wherein said means for releasably hermetically sealing together said tray member peripheral flange to said cover member peripheral flange includes a permanent hermetic seal and a grasping member for breaking said permanent hermetic seal in order to open said package.

27. The packaged bacon in accordance with claim 15, wherein at least a portion of said tray member peripheral flange extends beyond a corresponding portion of said cover member peripheral flange.

* * * * *

UNITED STATES PATENT AND TRADEMARK OFFICE

CERTIFICATE OF CORRECTION

PATENT NO. : 5,702,743

DATED : December 30, 1997

INVENTOR(S) : Cindie M. Wells

It is certified that error appears in the above-indentified patent and that said Letters Patent is hereby corrected as shown below:

Col. 1, line 16, "multiple-entire" should read --multiple entire--.
Col. 3, line 10, delete "an" after "showing".
Col. 6, line 4, "inside-surface" should read --inside surface--; line 40, "onto to another" should read --onto another--; line 46, delete "61" and insert --63--; line 47, delete "62" and insert --64--.
Col. 9, line 7, delete "bacon packaged" and insert --packaged bacon--.

Signed and Sealed this

Twenty-fourth Day of November, 1998

*Attest:*

*Attesting Officer*

BRUCE LEHMAN

*Commissioner of Patents and Trademarks*